US007965163B2

(12) United States Patent
Abe et al.

(10) Patent No.: US 7,965,163 B2
(45) Date of Patent: Jun. 21, 2011

(54) REACTOR CORE AND REACTOR

(75) Inventors: Toru Abe, Saitama (JP); Hiroki Hamakake, Saitama (JP); Keiko Kikuchi, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/440,232

(22) PCT Filed: Jan. 10, 2008

(86) PCT No.: PCT/JP2008/050182

§ 371 (c)(1),
(2), (4) Date: Aug. 14, 2009

(87) PCT Pub. No.: WO2008/087885

PCT Pub. Date: Jul. 24, 2008

(65) Prior Publication Data

US 2010/0171580 A1 Jul. 8, 2010

(30) Foreign Application Priority Data

Jan. 15, 2007 (JP) ..... 2007-005412
Jan. 30, 2007 (JP) ..... 2007-018743
Jan. 30, 2007 (JP) ..... 2007-018744

(51) Int. Cl.
*H01F 17/06* (2006.01)
*H01F 27/24* (2006.01)
*H01F 17/04* (2006.01)

(52) U.S. Cl. ..... 336/178; 336/212; 336/221; 336/233

(58) Field of Classification Search ..... 336/178, 336/233, 212, 221
See application file for complete search history.

(56) References Cited

U.S. PATENT DOCUMENTS 6,657,528 B1 * 12/2003 Tang ..... 336/178

FOREIGN PATENT DOCUMENTS

| | | | |
|---|---|---|---|
| JP | 03-036708 | | 2/1991 |
| JP | 03135007 | A * | 6/1991 |
| JP | 05109548 | A * | 4/1993 |
| JP | 2003-045724 | | 2/2003 |
| JP | 2005-019764 | | 1/2005 |
| JP | 2005-050918 | | 2/2005 |

(Continued)

OTHER PUBLICATIONS

English translation of Nakamura [JP 2003-045724 A].*

(Continued)

*Primary Examiner* — Anh T Mai
*Assistant Examiner* — Tszfung Chan
(74) *Attorney, Agent, or Firm* — Finnegan, Henderson, Farabow, Garrett & Dunner, LLP

(57) ABSTRACT

Provided is an annular reactor core formed of a U-shaped core and core legs. Core joints including end portions and two protrusions form the U-shaped core. Between the protrusions of these core joints, a plurality of (two) core legs 6 formed of core blocks are arranged so as to have gaps and the protrusions. The ratio A/B, which is a ratio of the length A of the protrusions of the core joint to the average length B of the core blocks constituting the core legs in a magnetic path direction, is optimized so as to be not less than 0.3 but not more than 8.0, whereby an increase in copper loss due to leak magnetic fluxes of the gap portions is suppressed.

18 Claims, 12 Drawing Sheets

FOREIGN PATENT DOCUMENTS

| | | | |
|---|---|---|---|
| JP | 2005137149 A | * | 5/2005 |
| JP | 2005-310988 | | 11/2005 |
| JP | 2005-347626 | | 12/2005 |

OTHER PUBLICATIONS

English translation of Hattori et al. [JP 2005-050918 A].*

English translation of Saka [JP 2005-310988 A].*

PCT Notification of Transmittal of Translation of the International Preliminary Report on Patentability, mailed Jul. 30, 2009, in International Application No. PCT/JP2008/050182 (7 pages).

PCT International Search Report mailed Apr. 22, 2008, in International Application No. PCT/JP2008/050182 (2 pages).

* cited by examiner

REACTOR CORE AND REACTOR

TECHNICAL FIELD

The present invention relates to a power circuit and, more particularly, to a reactor core and a reactor used in a hybrid electric vehicle.

BACKGROUND ART

Cores of power-circuit reactor can be broadly divided into three types. In the region of not more than several tens of kHz, silicon steel sheets, amorphous soft magnetic sheet strips, nanocrystalline soft magnetic sheet strips and the like are mainly used as core materials. These core materials contain iron as a main component and have the advantage that the saturation magnetic flux density $B_s$ and magnetic permeability $\mu$ are great. However, silicon steel sheets have the disadvantage that high-frequency core losses are great, and amorphous soft magnetic sheet strips and nanocrystalline soft magnetic sheet strips have the disadvantage that the core shape is restricted by the wound core shape, the laminated core shape and the like, and cannot be easily shaped into such various shapes as those made of ferrite, which will be described later.

In the region of not less than several tens of kHz, ferrite cores represented by Mn—Zn ferrite and Ni—Zn ferrite are widely used. The ferrite cores have small high-frequency core losses and molding is relatively easy and, therefore, the ferrite cores have the advantage that various shapes of cores can be mass produced. However, because the saturation magnetic flux density $B_s$ of the ferrite cores is as small as about ¼ to ½ of those of the above-described silicon steel sheets, amorphous soft magnetic sheet strips and nanocrystalline soft magnetic sheet strips, the sectional core area is large in order to avoid magnetic saturation in large-current reactors.

There are powder magnetic cores for use in the range from several kHz to several hundreds of kHz. Powder magnetic cores are obtained by working and molding after the surface of magnetic powders is subjected to an insulating process, and the occurrence of eddy current losses is suppressed by the insulating process.

Hybrid electric vehicles that have recently begun to rapidly come into widespread use have a large-output electric motor, and a reactor capable of withstanding a high voltage and a large current is used in a power circuit that drives this electric motor. The reactor is also used in a power conditioner and the like. Requirements for small designs, low-noise designs and low-loss designs are strong to the reactor, and core materials used in the reactor are required to provide high saturation magnetic flux densities $B_s$ and magnetic permeability $\mu_r$, in an appropriate range as magnetic properties. A description will be given below of the magnetic permeability $\mu_r$, in an appropriate range mentioned here.

The relationship $B=\mu_0\mu_r H$ exists between a magnetic field H and magnetic flux density B. In this expression, $\mu_0$ denotes the magnetic permeability in a vacuum and the magnetic field H is proportional to a current flowing in a reactor. For this reason, in a core material of high magnetic permeability, the saturation magnetic flux density $B_s$ is reached even in the case of a small reactor current, thereby causing core saturation. Therefore, designing has hitherto been carried out in such a manner that a magnetic material having a high saturation magnetic flux density $B_s$ is used as the reactor core material, the effective magnetic permeability $\mu_{re}$ is reduced by providing gaps in this core material, and a necessary inductance is obtained by adjustment with respect to the number of windings. For example, the effective magnetic permeability $\mu_{re}$ that is practicable in reactors for hybrid electric vehicles is in the range of approximately 10 to 50, and the effective magnetic permeability $\mu_{re}$ that is practicable in power conditioner reactors is in the range of approximately 30 to 100. Therefore, it is desirable to use the above-described powder magnetic cores.

In a large-current reactor core, magnetic materials having a high saturation magnetic flux density $B_s$ and low losses are used. In general, magnetic materials having a high saturation magnetic flux density $B_s$ and low losses also have a high magnetic permeability and, therefore, gaps are provided when these magnetic materials are used in the reactor core. Because the magnetic permeability of members that constitute the gaps is approximately 1, in the gaps is generated a fringing magnetic flux in which the magnetic flux leaks out to the outside of the magnetic path. For this reason, an eddy current is generated on the coil surface in the vicinity of the gaps, thereby posing the problem that losses increase.

For example, Japanese Patent Laid-Open No. 2005-50918 (Patent Document 1) discloses as an example an annular reactor core that is a powder magnetic core. In this reactor core, in order to suppress an increase in loss due to a fringing magnetic flux, a multiple-gap structure in which the gap length per place is reduced is used, and a reactor core having gaps in a total of six places is described. Also, a reactor core having gaps in a total of eight places is disclosed in Japanese Patent Laid-Open No. 2005-19764 (Patent Document 2) etc. Furthermore, Japanese Patent Laid-Open No. 2003-45724 (Patent Document 3) discloses as an example an annular reactor core in which core legs are integrally made. This reactor core is based on the premise that for the core legs, sheet materials are blanked and laminated, and that a study is carried out on the bonding strength and the number of laminations, which are used when the blanked materials are laminated.

DISCLOSURE OF THE INVENTION

Problems to be Solved by the Invention

Although other patent applications also have been filed concerning such reactor cores having a multiple-gap structure, no detailed examination of the shape of these reactor cores has been conducted. In the reactor cores and reactors of the conventional multiple-gap structure, magnetic fluxes leak from the gaps to the coil, thereby posing the problem that copper losses tend to increase. Although for example, Patent Document 2 (Japanese Patent Laid-Open No. 2005-19764) etc. disclose a reactor core having gaps in a total of eight places, there is no technical consideration for suppressing copper losses and there is room for studies. Hence, an object of the present invention is to provide a reactor core in which the shape of each core portion is optimized and an increase in copper loss is suppressed as far as possible.

Means for Solving the Problems

To solve the above problem, a first aspect of the present invention provides an annular reactor core comprising two opposed core joints and a plurality of core legs arranged between the core joints, which is characterized in that each of the core joints has a protrusion extending toward the core leg, that the core leg is formed of an integral core block, that a gap is formed between the core leg and the core joint, and that the ratio A/B, which is a ratio of the length A of the protrusion of the core joint to the average length B of the core legs in a magnetic path direction, is not less than 0.3 but not more than 8.0.

It is preferred that the reactor core be formed from a compacted body containing a magnetic powder and a resin. It is preferred that the magnetic permeability of this compacted body be not more than 200.

It is possible to make a reactor in which a reactor core of such a construction is used and a coil is wound around the core leg. Such a reactor is particularly useful as a reactor for a power conditioner.

A second aspect of the present invention provides an annular reactor core comprising two opposed core joints and a plurality of core legs arranged between the core joints, which is characterized in that each of the core joints has a protrusion extending toward the core leg, that the core leg has a gap formed between the core leg and the core joint and is composed of two core blocks, and that the ratio A/B, which is a ratio of the length A of the protrusion of the core joint to the average length B of the core blocks in a magnetic path direction, is not less than 0.8 but not more than 1.5.

Also in this case, it is preferred that the reactor core be formed from a compacted body containing a magnetic powder and a resin. It is preferred that the magnetic permeability of this compacted body be not more than 200.

It is possible to make a reactor in which a reactor core of such a construction is used and a coil is wound around the core leg. Such a reactor is particularly useful as a reactor for a hybrid electric vehicle (HEV).

A third aspect of the present invention provides an annular reactor core comprising two opposed core joints and a plurality of core legs arranged between the core joints, which is characterized in that each of the core joints has a protrusion extending toward the core leg, that the core leg has a gap formed between the core leg and the core joint and is composed of n core blocks (n being an integer of 3 or greater), and that the ratio A/B, which is a ratio of the length A of the protrusion of the core joint to the average length B of the core blocks in a magnetic path direction, is not less than 0.3 but not more than 4.0.

It is preferred that when the integer n is 3, the ratio A/B be not less than 0.6 but not more than 2.4. Also, it is preferred that when the integer n is 4, the ratio A/B be not less than 0.5 but not more than 3.5. Furthermore, it is preferred that when the integer n is 5, the ratio A/B be not less than 0.6 but not more than 3.3.

Also in this case, it is preferred that the reactor core be formed from a compacted body containing a magnetic powder and a resin. It is preferred that the magnetic permeability of this compacted body be not more than 200.

It is possible to make a reactor in which a reactor core of such a construction is used and a coil is wound around the core leg. Also such a reactor is particularly useful as a reactor for a hybrid electric vehicle (HEV).

Advantages of the Invention

According to the present invention, it is possible to obtain a high-efficiency reactor core in which an increase in copper loss due to leak magnetic fluxes of gap portions is suppressed, and a reactor.

BEST MODE FOR CARRYING OUT THE INVENTION

Figure 1:
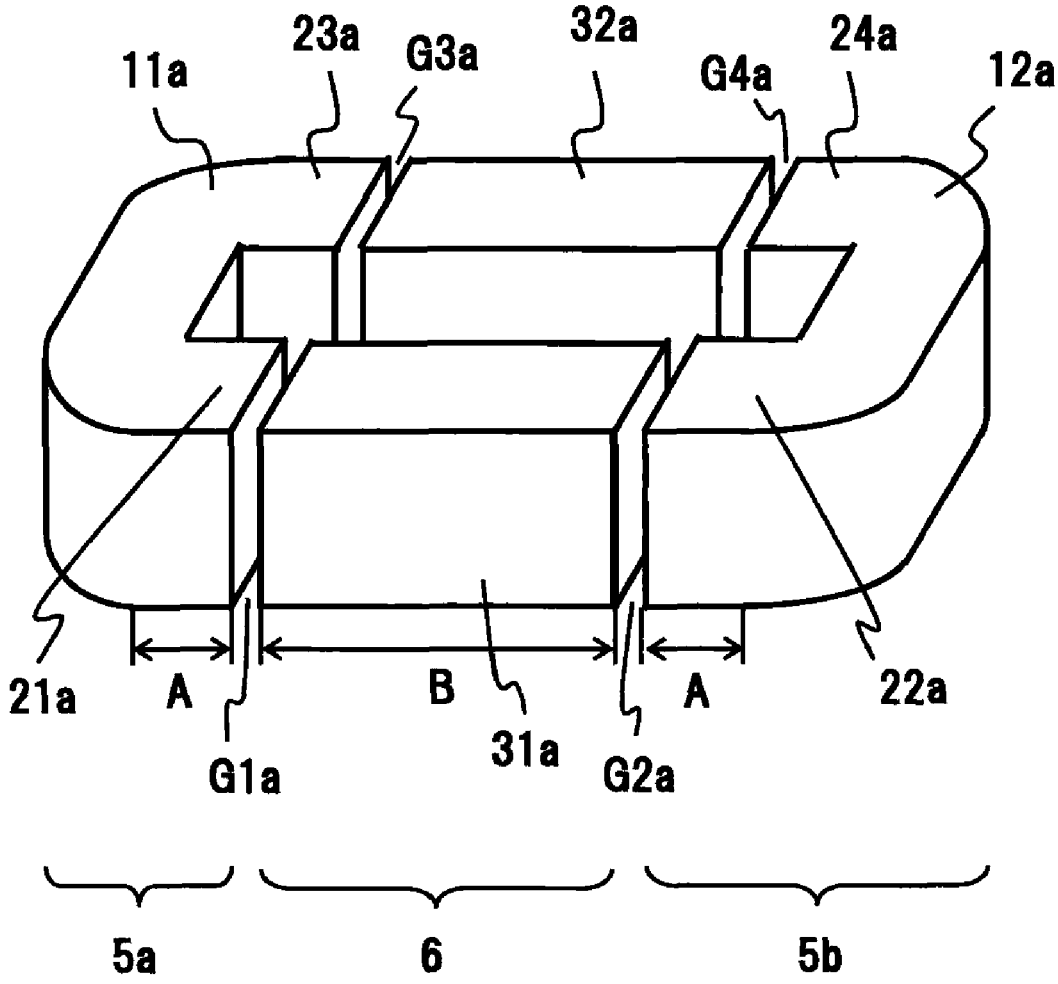
FIG. 1 is a diagram showing the whole core of a reactor according to the present invention.

FIG. 1 is a diagram to illustrate by an example the whole core of a reactor according to the present invention. This reactor core is an annular reactor core composed of a U-shaped core and core legs. A core joint 5*a* comprising an end portion 11*a* and two protrusions 21*a* and 23*a* is one U-shaped core, and a core joint 5*b* comprising an end portion 12*a* and two protrusions 22*a* and 24*a* is the other U-shaped core.

The present invention is based on the new knowledge that an increase in copper loss can be readily suppressed by providing the protrusions (21*a* and 23*a*; 22*a* and 24*a*) that protrude toward a plurality of (two) core legs 6 in the core joints 5*a* and 5*b* and by optimizing the ratio A/B, which is a ratio of the length A of the protrusion to the average length B of core blocks (31*a* and 32*a*) constituting the core legs in a magnetic path direction.

That is, when the above-described ratio A/B is too low, the reflux flow of a magnetic flux that flows from one protrusion (21*a*, 22*a*) of the core joint (5*a*, 5*b*) to the other protrusion (23*a*, 24*a*) via the core joint 6 is apt to stagnate and the amount of leak magnetic flux in an outermost gap increases, with the result that the coil AC resistance increases. On the other hand, when the ratio A/B is too high, a plurality of gaps in the core legs are arranged so as to be concentrated in the middle because of the large length of the protrusions of the core joints and, therefore, the magnetic resistance in these portions increases and the amount of fringing flux increases as a whole, with the result that the coil AC resistance increases.

Therefore, the fringing magnetic flux becomes small when the ratio A/B is set in a prescribed range, and it becomes possible to reduce eddy current losses that occur in the coil. Furthermore, by using this core, it is possible to realize a low-loss reactor. Although the range of the ratio A/B varies depending on the number of blocks (n) of the core legs, the value is in the range of 0.3 to 8.0 as described above.

Figure 2A:
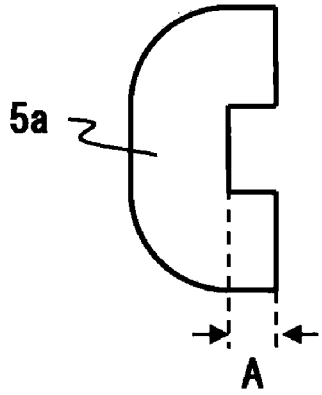
FIGS. 2A, 2B, and 2C are schematic diagrams to explain a protrusion of a core joint.
Figure 2B:
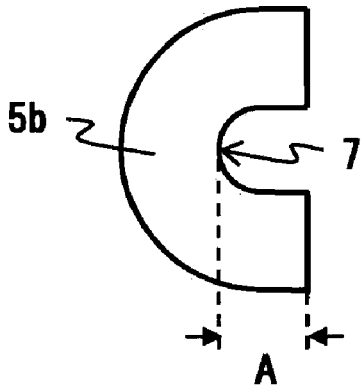
Figure 2C:
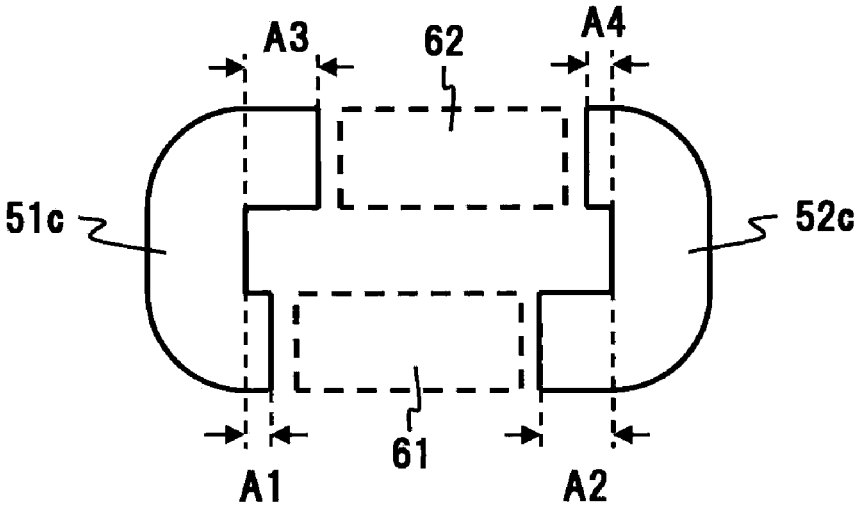

FIGS. 2A, 2B, and 2C are diagrams to explain in further detail the "length A of the protrusion" of the core joint to be used when the above-described ratio A/B is to be found. In the case of the roughly U-shaped core joint 5*a* shown in FIG. 2A, the length of an area projecting from a valley portion of the core joint toward the opposed core joint side becomes the "length A of the protrusion." Also, in the case of the core joint 5*b* whose inside diameter side is in the form of an circular arc as shown in FIG. 2B, the protruding length from a valley portion 7, which is a part most distant from a core joint (not shown in the figure) provided on the other end, is regarded as the "length A of the protrusion." Furthermore, when the protrusions of the core joints (51*c*, 52*c*) provided on both ends of the core blocks (61, 62) have different lengths (A1 to A4) as in the case shown in FIG. 2C, an average value of the lengths of the protrusions ([A1+A2+A3+A4]/4) is regarded as the "length A of the protrusion."

Incidentally, in the present invention, the "average length B of the core blocks in a magnetic path direction" is an average value of the lengths of the core blocks.

It is preferred that the sectional area of the protrusions in a magnetic path direction be equal to the sectional area of the core blocks in a magnetic path direction. If the sectional areas are the same, leak magnetic fluxes are less apt to be generated in the gaps between the protrusions and the core blocks, and hence an increase in copper loss can be suppressed.

It is preferred that the sectional area of the core joints in a magnetic path direction be equal to or larger than the sectional area of the protrusions in a magnetic path direction and the sectional area of the core blocks in a magnetic path direction. By forming these core joints, protrusions and core blocks with this size, it is possible to suppress an increase in copper loss in the same manner as described above.

In order to facilitate the assembling of the core and press molding, it is preferred that the core blocks be I-shaped core blocks in the form of a rectangular parallelepiped. When core blocks in the shape of a trapezoid are used, the average length B of the core blocks in a magnetic path direction is a length that extends along a middle portion of the magnetic path (a gravity-center portion of the magnetic path section).

As a result of studies, it became apparent that an optimum ratio A/B changes depending on the number of core blocks. Although details will be described in examples, it is preferred that when the number of blocks (n) is 1, the ratio A/B, which is a ratio of the length A of the protrusion of the core joint to the length B of the core blocks in a magnetic path direction, be not less than 0.3 but not more than 8.0. Compared to a case where the core joint is not provided with a protrusion (a case where the ratio A/B=0), it is possible to reduce the coil AC resistance by as much as not less than 40%.

Furthermore, it is preferred that the ratio A/B be not less than 0.5 but not more than 4.0. By adopting this range, it is possible to reduce the coil AC resistance as much as not less than 45%. The ratio A/B that is more preferable is not less than 0.7 but not more than 2.3. By adopting this range, it is possible to reduce the coil AC resistance as much as not less than 50%. Particularly, when the length obtained by adding all widths of gaps is 1 to 3% of the magnetic path length, it is possible to obtain reductions in coil AC resistance equivalent to the above-described values.

It is preferred that when the number of blocks (n) is 2, the ratio A/B, which is a ratio of the length A of the protrusion of the core joint to the length B of the core blocks in a magnetic path direction, be not less than 0.8 but not more than 1.5. Compared to a case where the core joint is not provided with a protrusion (a case where the ratio A/B=0), it is possible to reduce the coil AC resistance by as much as not less than 50%. Furthermore, it is preferred that the ratio A/B be not less than 0.9 but not more than 1.3.

It is preferred that when the number of blocks (n) is 3, the ratio A/B, which is a ratio of the length A of the protrusion of the core joint to the length B of the core blocks in a magnetic path direction, be not less than 0.6 but not more than 2.4. Compared to a case where the core joint is not provided with a protrusion (a case where the ratio A/B=0), it is possible to reduce the coil AC resistance by as high as not less than 30%. Furthermore, it is preferred that the ratio A/B be not less than 0.8 but not more than 2.0. By adopting this range, it is possible to reduce the coil AC resistance as much as not less than 35%.

It is preferred that when the number of core blocks (n) is 4, the ratio A/B, which is a ratio of the length A of the protrusion of the core joint to the length B of the core blocks in a magnetic path direction, be not less than 0.5 but not more than 3.5. Compared to a case where the core joint is not provided with a protrusion (a case where the ratio A/B=0), it is possible to reduce the coil AC resistance by as high as not less than 15%. Furthermore, it is preferred that the ratio A/B be not less than 0.8 but not more than 2.2. By adopting this range, it is possible to reduce the coil AC resistance as much as not less than 20%.

It is preferred that when the number of core blocks (n) is 5, the ratio A/B, which is a ratio of the length A of the protrusion of the core joint to the length B of the core blocks in a magnetic path direction, be not less than 0.6 but not more than 3.3. Compared to a case where the core joint is not provided with a protrusion (a case where the ratio A/B=0), it is possible to reduce the coil AC resistance by as high as not less than 13%. Furthermore, it is preferred that the ratio A/B be not less than 0.8 but not more than 2.8. By adopting this range, it is possible to reduce the coil AC resistance as much as not less than 15%.

It is preferred that the above-described reactor cores be formed from a compacted body containing a soft magnetic powder and a resin. Soft magnetic powders are each insulated by the resin, whereby it is possible to obtain a reactor core of low iron loss. In general, laminates obtained by laminating known materials, such as silicon steel sheets, amorphous soft magnetic sheet strips, and nanocrystalline soft magnetic sheet strips, are used as the materials for reactor cores. When these laminates are used, the range of the ratio A/B, which is a ratio of the length A of the protrusion of the core joint to the length B of the core blocks in a magnetic path direction, varies greatly, because the magnetic permeability $\mu_r$ of the laminate is different from the magnetic permeability of a compacted body formed from soft magnetic powder.

Examples of the above-described magnetic powder include a powder of pure iron, an Fe—Si alloy powder, an Fe—Al alloy powder, an Fe—Si—Al alloy powder, an Fe—Ni alloy powder, an Fe—Co alloy powder, an amorphous soft magnetic powder, and a nanocrystalline soft magnetic powder. Incidentally, these powders may be each used singly or may be used by being appropriately combined. Because the magnetic permeability $\mu_r$ of the compacted body of these magnetic powders is in the range of not more than 200 at a maximum, a high-efficiency reactor of small copper loss is obtained by making a reactor core at the dimensional ratio specified in the present invention. The magnetic permeability $\mu_r$ of a magnetic powder is preferably not more than 150, more preferably not more than 100.

The resin used in the present invention coats the surfaces of these magnetic powders and brings the powders into an insulated condition with each other, whereby a sufficient electric resistance is provided so that eddy current losses for the AC magnetization of the whole core do not become large, and at the same time, the resin functions also as a binder that bonds these powders together. Examples of such resins include various resins, such as epoxy resin, polyamide resin, polyimide resin and polyester resin, and these resins may be used singly or in appropriate combinations.

As the molding method of the core of a compacted body used in the present invention, there are a cast molding method by which a mixture of the above-described magnetic powder and resin is once liquefied and thereafter cast into a mold and solidified, an injection molding method that involves molding the mixture by injection-molding the mixture in a mold, a press molding method by which a mixture composed of a magnetic powder and a binder of an organic substance or an inorganic substance is filled in a mold and pressurized to mold a powder magnetic core, and the like.

The gap (G) between the core joint and the core leg is an area having a magnetic permeability magnetically equivalent to the magnetic permeability of voids, and is not limited to an air gap, but a plate-like member of a nonmagnetic material, such as resin, may be used. Positioning can be readily performed by using this plate-like member.

The thickness of the core joint and the core leg is to be appropriately determined according to the size of a reactor as a final product and necessary reactor characteristics. In a reactor in which a laminated steel sheet is used, it becomes necessary to give consideration to measures, such as reducing the number of laminates of steel sheets by making small the lamination direction of each part. When a compacted body is used as in the present invention, it is possible to perform designing freely without considering these concerns.

If the reactor core height is denoted by "h" and the width of each part orthogonal to a magnetic path is denoted by "d," then the sectional area "s" orthogonal to the magnetic path becomes (h×d). Particularly, for the core leg, it is necessary to wind a coil around the core leg and, therefore, the shorter the circumferential length of the core leg, the more desirable. Hence, even when the same sectional area "s" is to be obtained, the closer values of the height "h" and the width "d" to each other, the shorter the circumferential length. As a result of this, the length of a coil wound becomes short, resulting in reduced cost and also leading to weight savings. However, as described above, it is necessary to adapt the dimensional ratio of the height "h" and the width "d" to the mountability of a reactor core as a desired final product.

Next, the present invention will be concretely described with the aid of examples. However, the present invention is not limited by these examples.

Example 1

As a reactor core of the present invention, first, an annular reactor core having the shape shown in FIG. 1 was fabricated. In FIG. 1, the core joint 5*a* is a U-shaped core comprising the end portion 11*a* and the protrusions 21*a*, 23*a*, and the core joint 5*b* provided at the other end is a U-shaped core comprising the end portion 12*a* and the protrusions 22*a*, 24*a*. The end portion 11*a* and the protrusions 21*a*, 23*a* were fixed together, whereby the magnetically integrated core joint 5*a* was obtained. Similarly, the end portion 12*a* and the protrusions 22*a*, 24*a* were fixed together, whereby the magnetically integrated core joint 5*b* was obtained. Incidentally, the end portions (11*a*, 12*a*) and the protrusions (21*a*, 23*a*; 22*a*, 24*a*) may be formed as a one piece from the beginning in addition to the case where these are fixed together after being separately formed.

Figure 3:
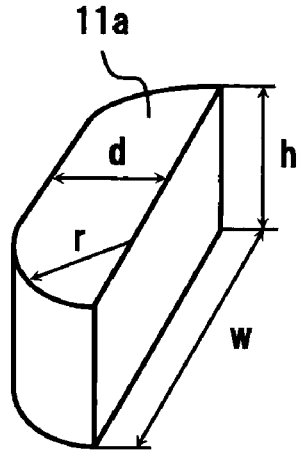
FIG. 3 is a diagram to explain the shape of an end portion of a core joint.

FIG. 3 is a diagram to explain the shape of the end portion 11*a*. In this figure, "h" denotes the height of the end portion 11*a*, "w" denotes the longitudinal width of the end portion 11*a*, "d" denotes the transverse width of the end portion 11*a*, and "r" denotes the curved surface of the end portion 11*a*.

Between the core joints (5*a*, 5*b*), the two I-shaped core blocks 31*a* and 32*a* are disposed via gaps G1*a* to G4*a*. These two I-shaped core blocks (31*a*, 32*a*) provide the core leg 6. Incidentally, the gaps G1*a* to G4*a* are buried with a plate-like ceramic gap material (not shown in the figure). The adopted total gap length obtained by adding all lengths of the gaps G1*a* to G4*a* was 5.4 mm. Incidentally, the width of each gap was constant.

In the core joints (5*a*, 5*b*) and the I-shaped core blocks (31*a*, 31*b*) of the core legs, a mixture obtained by adding 1.5 parts by weight of kaolin and 1.5 parts by weight of water glass to an Fe-6.5% Si alloy powder was used. This mixture was compression molded at an ordinary temperature and at a molding pressure of 1200 MPa and thereafter the green compact was subjected to heat treatment at a temperature of 1073 K in a nitrogen atmosphere. The magnetic permeability $\mu_r$ of this compacted body was 50. The adopted end-to-end distance (the distance between 11*a* and 12*a*) of the core joints was 85.2 mm. The above-described end-to-end distance of the core joints is a total of the lengths of the protrusion 21*a*, the protrusion 22*a*, the gap G1, the gap G2, and the I-shaped core block 31*a*.

For the end portions 11*a*, 12*a* of the core joints 5*a*, 5*b*, the shape of the side opposite to the side where the protrusions 21*a* to 24*a* were fixed, was such that the external portions were rounded so as to curve along the magnetic path. The sectional area of the end portions 11*a*, 12*a*, the sectional area of the protrusions 21*a* to 24*a*, and the sectional area of the I-shaped core blocks 31*a*, 32*a* of the core legs 6, all orthogonal to the magnetic path, were made equal to each other. For the adopted dimensions of the end portions 11*a*, 12*a*, the height "h" was 32 mm, the longitudinal width "w" was 60 mm, the transverse width "d" was 20.5 mm, and the curved surface "r" of the end portions had a radius of 20.5 mm.

Furthermore, reactor cores in which the length A of the protrusions 21*a*, 22*a* and the length B of the I-shaped core blocks 31*a*, 32*a* were changed, were fabricated. Incidentally, to ensure that the magnetic path length becomes constant, the selected end-to-end distance of the core joints (a total of the lengths of the protrusions 21*a*, 22*a*, the gap G1*a*, the gap G2*a*, and the I-shaped core block 31*a*) was 85.2 mm, a constant value. Furthermore, the adopted gap length (a total of the gaps G1*a* to G4*a*) was also 5.4 mm (one side, 2.7 mm), a constant value.

Coils with 76 turns of the same wire material were mounted to the core legs of the reactor core and reactors with an inductance of approximately 450 μH at 20 A of a DC superimposed current were fabricated, and a comparison was made to know how the coil AC resistance varies depending on the ratio A/B. Table 1 shows the values of the length A of the protrusion, the length B of the I-shaped core block, the dimensional ratio A/B, and the coil AC resistance in each of the reactors that were compared. The coil AC resistance values of Table 1 were obtained by measuring the series resistance of the above-described reactors at a voltage level of 0.5 V and a frequency of 10 kHz by using the measuring instrument of precision LCR meter 4284A (made by Agilent Technologies, Inc.) Incidentally, the AC resistance of the coil with 76 turns alone was 0.121Ω.

TABLE 1

| Number | Dimension A (mm) | Dimension B (mm) | Ratio A/B | Coil AC resistance (O) |
|---|---|---|---|---|
| 1-1 | 0 | 82.5 | 0.0 | 0.418 |
| 1-2 | 6.9 | 68.7 | 0.1 | 0.356 |
| 1-3 | 11.8 | 58.9 | 0.2 | 0.301 |
| 1-4 | 15.5 | 51.5 | 0.3 | 0.243 |
| 1-5 | 20.6 | 41.3 | 0.5 | 0.209 |
| 1-6 | 24.1 | 34.3 | 0.7 | 0.187 |
| 1-7 | 29.1 | 24.3 | 1.2 | 0.178 |
| 1-8 | 33.9 | 14.7 | 2.3 | 0.191 |
| 1-9 | 36.7 | 9.1 | 4.0 | 0.210 |
| 1-10 | 38.1 | 6.3 | 6.0 | 0.226 |
| 1-11 | 38.82 | 4.86 | 8.0 | 0.240 |

Figure 4:
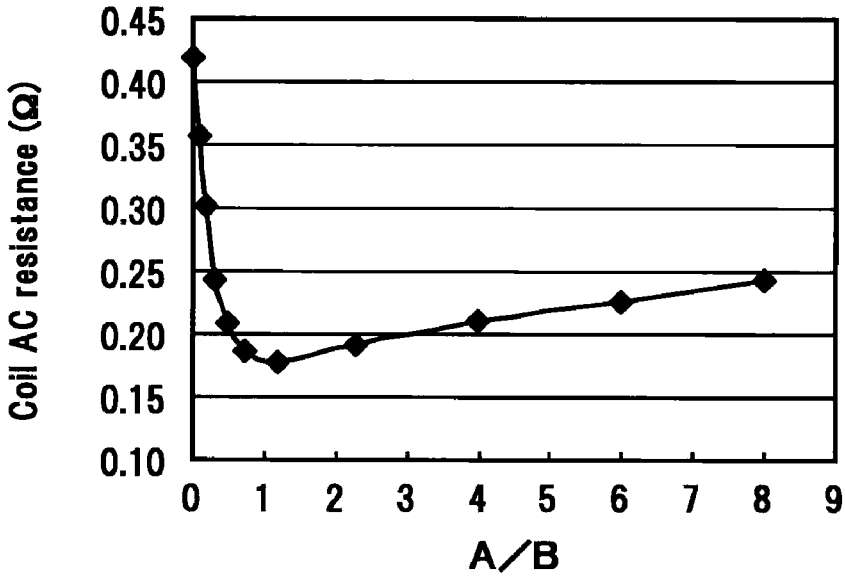
FIG. 4 is a characteristic diagram showing the relationship between the coil AC resistance of a reactor (the number of blocks=1) according to the present invention and the ratio A/B.

FIG. 4 is a diagram showing the relationship between the ratio A/B and the coil AC resistance of Table 1 as a graph. It became apparent from this figure that the coil AC resistance becomes a minimum at a ratio A/B in the vicinity of 1.2. The coil AC resistance becomes not more than 0.2Ω when the ratio A/B is in the range of 0.6 to 3.

In the core joints of the above-described example, the two corner surfaces on the outside provide a curved surface having a radius r of 20.5 mm. However, the same tendency in the ratio A/B and the coil AC resistance was observed also in a case where the core joints were in the shape of a rectangular parallelepiped.

Example 2

Annular reactor cores were fabricated in the same shape as in Example 1. The gap length (a length obtained by adding G1*a* to G4*a*) was doubled compared to the reactors of Example 1 and the adopted gap length was 10.8 mm (one side, 5.4 mm). The adopted width of each gap was constant. The adopted distance between the core joints 11*a*, 12*a* (a length obtained by adding the lengths of the protrusions 21*a*, 22*a*, the gaps G1*a*, G2*a*, and the I-shaped core block 31*a*) was 87.9 mm. The shape of the end portions 11*a*, 12*a* is the same as in Example 1. Also, with the shapes of the I-shaped core blocks 31*a*, 32*a* and the protrusions 21*a*, 22*a* being the same as in Example 1, annular reactor cores having the same shapes as shown in Table 1 were fabricated.

In the same manner as in Example 1, coils with 76 turns of the same wire material were mounted to the core legs of the reactor core and reactors with an inductance of approximately 275 μH at 60 A of a DC superimposed current were fabricated, and a comparison was made to know how the coil AC resistance varies depending on the ratio A/B. Table 2 shows the values of the length A of the protrusion, the length B of the I-shaped core block, the dimensional ratio A/B, and the coil AC resistance in each of the reactors that were compared.

TABLE 2

| Number | Dimension A (mm) | Dimension B (mm) | Ratio A/B | Coil AC resistance (O) |
|---|---|---|---|---|
| 2-1 | 0 | 82.5 | 0.0 | 0.804 |
| 2-2 | 6.9 | 68.7 | 0.1 | 0.717 |
| 2-3 | 11.8 | 58.9 | 0.2 | 0.618 |
| 2-4 | 15.5 | 51.5 | 0.3 | 0.513 |
| 2-5 | 20.6 | 41.3 | 0.5 | 0.452 |
| 2-6 | 24.1 | 34.3 | 0.7 | 0.418 |
| 2-7 | 29.1 | 24.3 | 1.2 | 0.416 |
| 2-8 | 33.9 | 14.7 | 2.3 | 0.457 |
| 2-9 | 36.7 | 9.1 | 4.0 | 0.509 |
| 2-10 | 38.1 | 6.3 | 6.0 | 0.561 |
| 2-11 | 38.82 | 4.86 | 8.0 | 0.602 |

Figure 5:
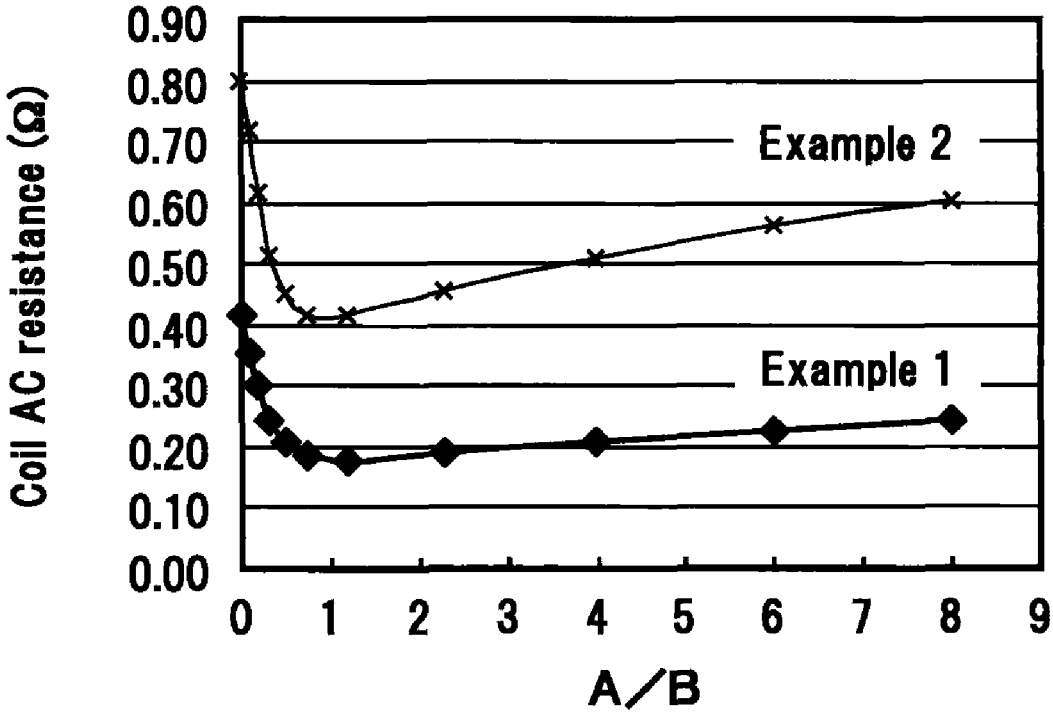
FIG. 5 is a characteristic diagram showing the relationship between the coil AC resistance of a reactor in Example 2 and the ratio A/B.

FIG. 5 is a diagram showing the relationship between the ratio A/B and the coil AC resistance of Table 2 as a graph. The results of Example 1 (Table 1) are also shown in this figure. The increase and decrease relationship between the ratio A/B and the coil AC resistance is the same as in Example 1 although the values of coil AC resistance are higher in the reactor cores of Example 2 because of the larger total gap length.

Example 3

Figure 6:
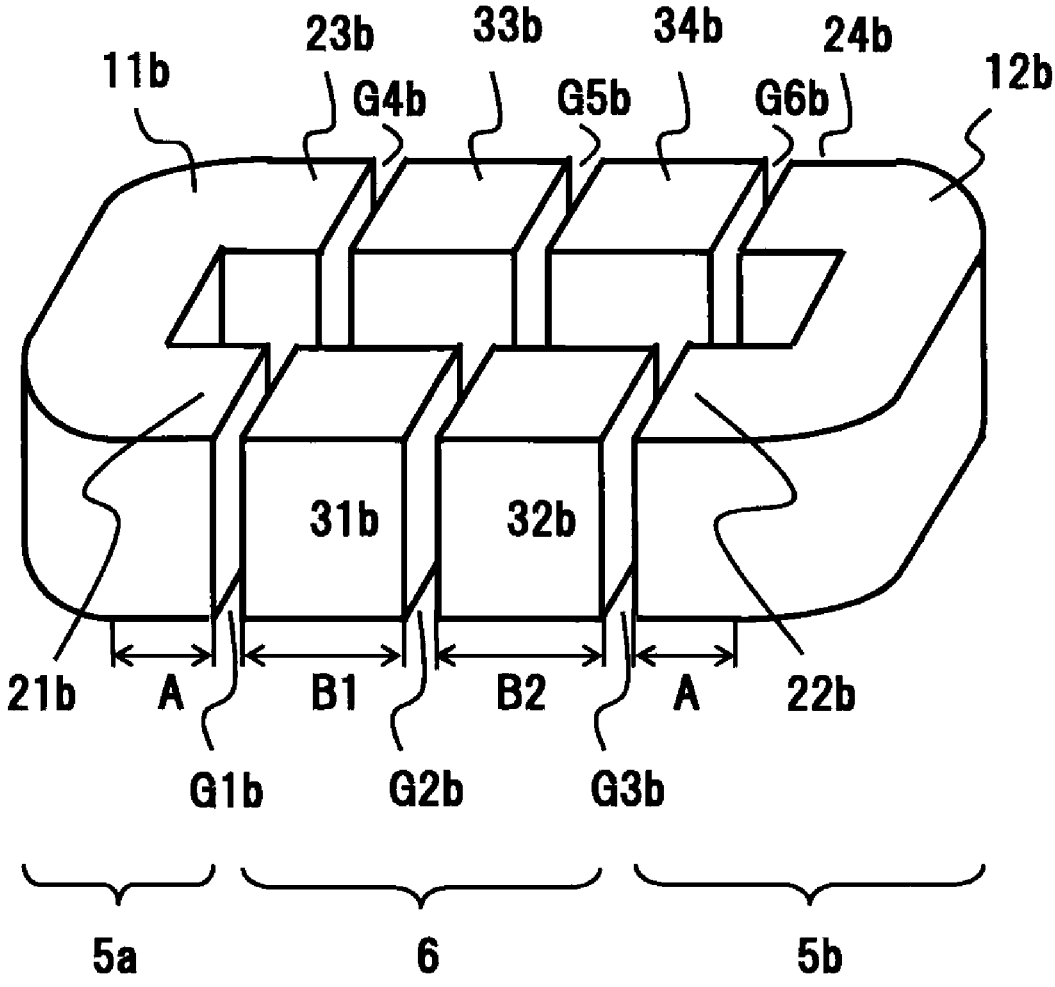
FIG. 6 is a diagram showing the whole core of a reactor in Example 3.

FIG. 6 is a diagram to explain an annular reactor core fabricated in this example. In FIG. 6, a core joint 5*a* is a U-shaped core comprising an end portion 11*b* and protrusions 21*b*, 23*b*, and a core joint 5*b* provided at the other end is a U-shaped core comprising an end portion 12*b* and protrusions 22*b*, 24*b*. The shape of the end portions 11*b* (and 12*b*) in this case is the same as already shown in FIG. 3.

Core legs 6, which are provided with I-shaped core blocks (31*b*, 33*b*) having a length B1 and I-shaped core blocks (32*b*, 34*b*) having a length B2, have a gap G formed between the core legs and the core joints 5*a* and 5*b*. The I-shaped core blocks 31*b* to 34*b* have the same sectional dimensions and the same shape as the protrusions 21*b* to 24*b*. The I-shaped core blocks 31*b* to 34*b* are disposed in a tandem manner each in a pair (31*b* and 32*b*; 34*b* and 35*b*), with gaps G1*b*, G2*b* and G3*b* formed between the I-shaped core blocks 31*b*, 32*b* and the protrusions 21*b* and 22*b*, and with gaps G4*b*, G5*b* and G6*b* formed between the I-shaped core blocks 33*b*, 34*b* and the protrusions 23*b* and 24*b*. Incidentally, though not shown in the figure, a plate-like ceramic material is used as the gap material in the gaps G1*b* to G6*b*. The adopted total gap length obtained by adding the lengths of all of the gaps G1*b* to G6*b* was 10.8 mm. The width of each gap was constant.

In the core joints 5*a*, 5*b* and each of the I-shaped core blocks 31*b* to 34*b* of the core legs 6, a mixture obtained by adding 1.5 parts by weight of kaolin and 1.5 parts by weight of water glass to an Fe-6.5% Si alloy powder was used. This mixture was compression molded at an ordinary temperature and at a molding pressure of 1200 MPa and thereafter the green compact was subjected to heat treatment at a temperature of 1073 K in a nitrogen atmosphere. The magnetic permeability $\mu_r$ of this compacted body was 50.

The adopted end-to-end distance (the distance between 11*b* and 12*b*) of the core joints was 87.9 mm. The above-described end-to-end distance of the core joints is a total of the lengths of the protrusion 21*b*, the protrusion 22*b*, the gap G1*b*, the gap G2*b*, the gap G3*b*, the I-shaped core block 31*b*, and the I-shaped core block 32*b*.

For the end portions 11*b*, 12*b* of the core joints 5*a*, 5*b*, the shape of the side opposite to the side where the protrusions 21*b* to 24*b* were fixed, was such that the external portions were rounded so as to curve along the magnetic path. The sectional area of the end portions 11*b*, 12*b*, the sectional area of the protrusions 21*b* to 24*b*, and the sectional area of the I-shaped core blocks 31*b* to 34*b* of the core legs 6, all orthogonal to the magnetic path, were made equal to each other. For the adopted dimensions of the end portion 11*b*, the height "h" was 32 mm, the longitudinal width "w" was 60 mm, the transverse width "d" was 20.5 mm, and the end portion was a curved surface having a radius "r" of 20.5 mm. For the dimensions of the protrusions 21*b* to 24*b*, the length A was 16.5 mm and the height was 32 mm. The ratio A/B, which is a ratio of the length A of the protrusion to the average length B of the I-shaped core blocks in a magnetic path direction, is 1.0. This corresponds to number 1-4 in Table 3 below.

Furthermore, reactor cores in which the length A of the protrusions 21*b*, 22*b* and the length B of the I-shaped core blocks (an average value of the lengths of the I-shaped core block 31*b* or 33*b* and the lengths of the I-shaped core block 32*b* or 34*b*) were changed, were fabricated. To ensure that the magnetic path length becomes constant, the selected distance of the core joints between the core joints 11*b* and 12*b* (a length obtained by adding the lengths of the protrusions 21*b*, 22*b*, the gaps G1*b* to G3*b*, and the I-shaped core blocks 31*b*, 32*b*) was 87.9 mm, a constant value. The adopted gap length (a length obtained by adding the lengths of the gaps G1*b* to G6*b*) was also 10.8 mm (one side, 5.4 mm), a constant value. Coils with 76 turns of the same wire material were mounted to the core legs of the reactor core and reactors with an inductance of approximately 275 μH at 60 A of a DC superimposed current were fabricated, and a comparison was made to know how the coil AC resistance varies depending on the ratio A/B.

Table 3 shows the values of the length A of the protrusion, the length B of the I-shaped core block, the dimensional ratio A/B, and the coil AC resistance in each of the reactors. The coil AC resistance values shown in Table 3 were obtained by measuring the series resistance of the above-described reactors at a voltage level of 0.5 V and a frequency of 10 kHz by using the measuring instrument of precision LCR meter 4284A (made by Agilent Technologies, Inc.) Incidentally, the AC resistance of the coil with 76 turns alone was 0.121Ω.

TABLE 3

| Number | Dimension A (mm) | Dimension B (mm) | Ratio A/B | Coil AC resistance (O) |
|---|---|---|---|---|
| 1-1 | 0 | 41.2 | 0.0 | 0.616 |
| 1-2 | 6.9 | 34.4 | 0.2 | 0.464 |
| 1-3 | 11.8 | 29.5 | 0.4 | 0.375 |
| 1-4 | 15.5 | 25.8 | 0.6 | 0.311 |
| 1-5 | 18.3 | 22.9 | 0.8 | 0.299 |
| 1-6 | 19.5 | 21.7 | 0.9 | 0.296 |
| 1-7 | 20.6 | 20.6 | 1.0 | 0.295 |
| 1-8 | 23.3 | 17.9 | 1.3 | 0.297 |
| 1-9 | 24.7 | 16.5 | 1.5 | 0.303 |
| 1-10 | 29.1 | 12.1 | 2.4 | 0.350 |
| 1-11 | 33.0 | 8.2 | 4.0 | 0.420 |

Figure 7:
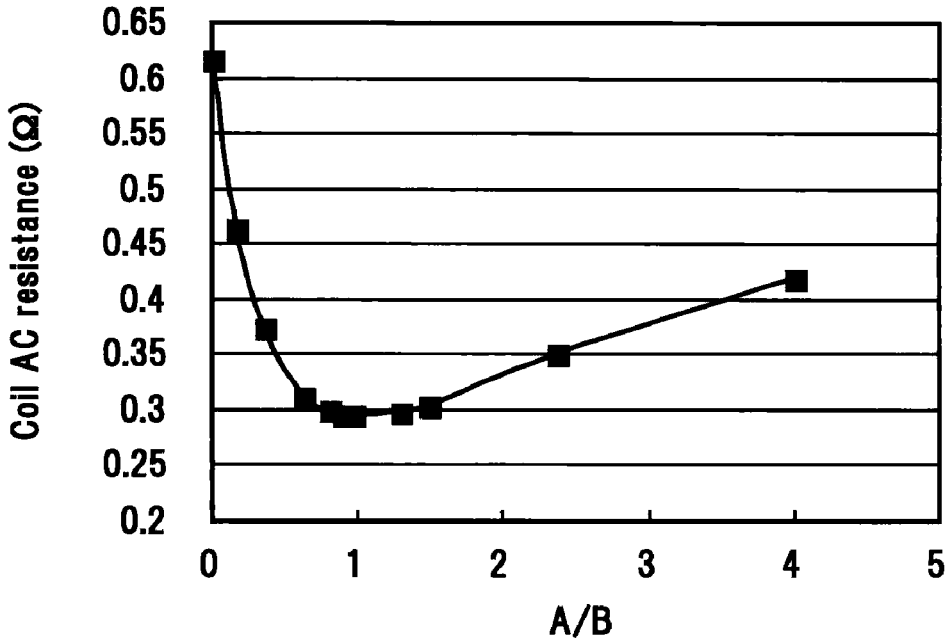
FIG. 7 is a characteristic diagram showing the relationship between the coil AC resistance of a reactor (the number of blocks=2) in Example 3 and the ratio A/B.

FIG. 7 is a diagram showing the relationship between the ratio A/B and the coil AC resistance of Table 3 as a graph. It became apparent from FIG. 7 that the coil AC resistance becomes a minimum at a ratio A/B in the vicinity of 1.2. The coil AC resistance becomes not more than 0.310Ω when the ratio A/B is in the range of 0.8 to 1.5. The coil AC resistance becomes not more than 0.30Ω when the ratio A/B is in the range of 0.9 to 1.3.

In the core joints of the above-described example, the two corner surfaces on the outside provide a curved surface having a radius "r" of 20.5 mm. However, the same tendency in the ratio A/B and the coil AC resistance was observed also in a case where the core joints were in the shape of a rectangular parallelepiped.

Example 4

In this example, an investigation was made to know how the relationship between the ratio A/B and the coil AC resistance varies when the dimensions of the two I-shaped core blocks (31*b* and 32*b*; 33*b* and 34*b*) of the core legs 6 of the annular reactor core in Example 3 are changed.

Figure 8:
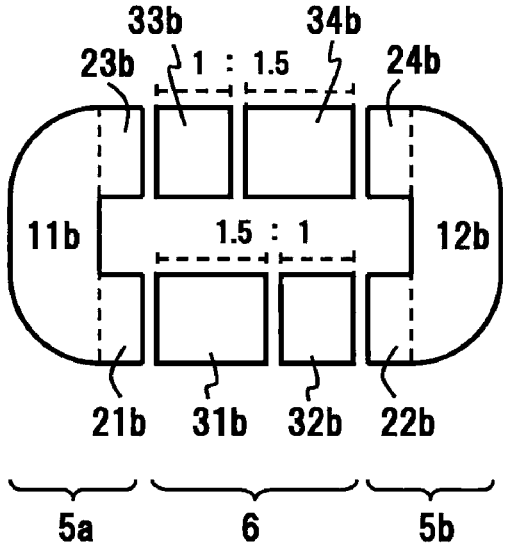
FIG. 8 is a schematic diagram showing the dimensional relationship of the core of a reactor in Example 4.

FIG. 8 is a diagram to explain an annular reactor core fabricated in this example. In the same manner as shown in FIG. 6, a core joint 5*a* is a U-shaped core comprising an end portion 11*b* and protrusions 21*b*, 23*b*, and a core joint 5*b* provided at the other end is a U-shaped core comprising an end portion 12*b* and protrusions 22*b*, 24*b*. Incidentally, the shape of the end portions 11*b* (and 12*b*) in this case is the same as already shown in FIG. 3.

A core leg 6 is composed of a row in which I-shaped core blocks 31*b* and 32*b* are arranged in a tandem manner and a row in which I-shaped core blocks 33*b* and 34*b* are arranged in a tandem manner. The length ratio of the I-shaped core block 31*b* to the I-shaped core block 32*b* is 1.5:1, and the length ratio of the I-shaped core block 33*b* to the I-shaped core block 34*b* is 1:1.5. The I-shaped gaps are arranged so that gaps similar to those shown in FIG. 6 are formed.

Incidentally, the adopted distance between the core joints 11*b*, 12*b* (a length obtained by adding the lengths of the protrusions 21*b*, 22*b*, the gaps G1*b* to G3*b*, and the I-shaped core blocks 31*b*, 32*b*) was 87.9 mm, the same value as in Example 3. Also the gap length (a length obtained by adding the lengths of G1*b* to G6*b*) was 10.8 mm (one side, 5.4 mm), a constant value. Other dimensions, the materials for the core joints 5*a*, 5*b* and the core legs 6, the manufacturing method and the like were the same as in Example 3. Also in this case, the adopted length B of the I-shaped core blocks was, as described above, an average value of the lengths of the two different I-shaped core blocks (an average value of the length of the I-shaped core block 31*b* or 33*b* and the length of the I-shaped core block 32*b* or 34*b*).

Figure 9:
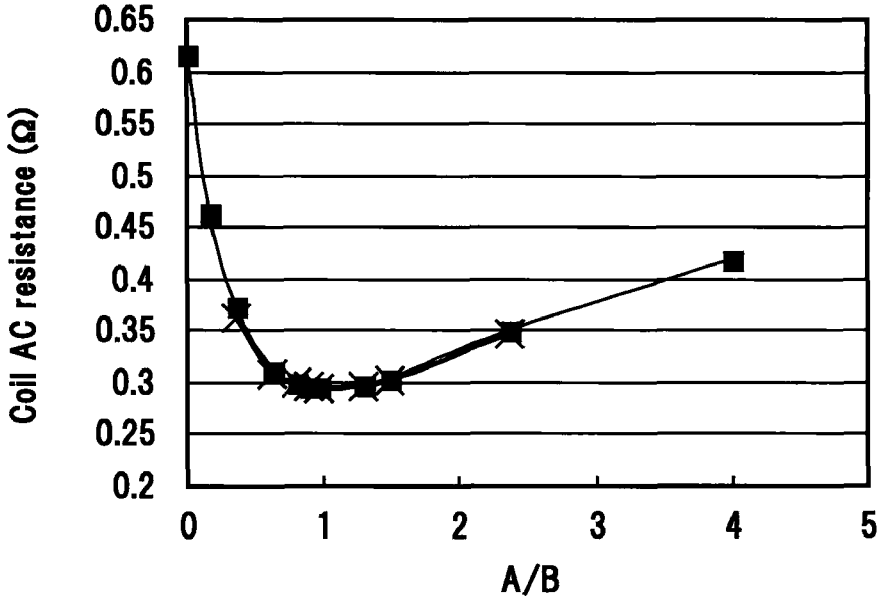
FIG. 9 is a characteristic diagram showing the relationship between the coil AC resistance and the ratio A/B, which is obtained when the dimension of each I-shaped core block within a reactor in Example 4 is changed.

FIG. 9 is a diagram to explain the relationship between the ratio A/B and the coil AC resistance. Even when the dimensions of the I-shaped core blocks are changed, this has little effect on the relationship between the ratio A/B and the coil AC resistance. This result means that even when the length of the I-shaped core blocks of the core legs is changed as required, the coil AC resistance is not so reduced as expected. Therefore, it is apparent that controlling the ratio A/B is important for reducing the coil AC resistance. Incidentally, giving the same length to the I-shaped core blocks is desirable in terms of molding work and assembling work, and besides this has the effect of reducing noise because the core structure becomes laterally symmetrical.

Example 5

Figure 10:
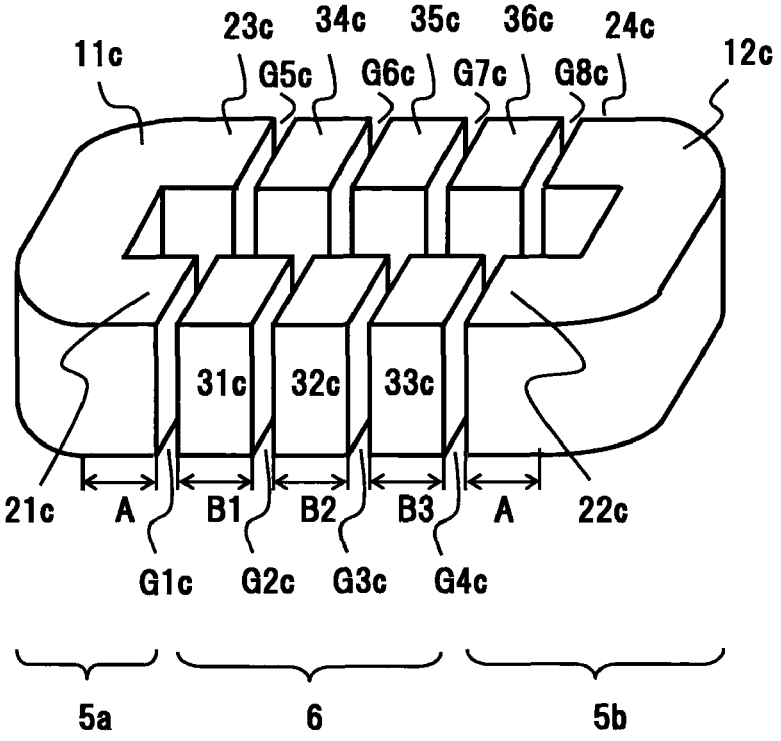
FIG. 10 is a diagram showing the whole core of a reactor in Example 5.

FIG. 10 is a diagram to explain an annular reactor core fabricated in this example. A core joint 5*a* is a U-shaped core comprising an end portion 11*c* and protrusions 21*c*, 23*c*, and a core joint 5*b* provided at the other end is a U-shaped core comprising an end portion 12*c* and protrusions 22*c*, 24*c*. Incidentally, the shape of the end portions 11*c* (and 12*c*) in this case is the same as already shown in FIG. 3.

A core leg 6 is composed of a row in which I-shaped core blocks 31*c*, 32*c* and 33*c* are arranged in a tandem manner and a row in which I-shaped core blocks 34*c*, 35*c* and 36*c* are arranged in a tandem manner. Incidentally, all of these I-shaped core blocks 31c to 36c have the same dimensions and shape as the protrusions 21c to 24c, and have the same length. The I-shaped core blocks 31c to 36c are arranged so that gaps G (G1c to G4c; G5c to G8c) are generated between the core legs 6 and the core legs 5a, 5b and between the I-shaped core blocks. Incidentally, though not shown in the figure, plate-like ceramics are used as gap materials in the gaps (G1c to G8c). The adopted total gap length obtained by adding the lengths of all of the gaps G1c to G8c is 10.8 mm.

In the core joints 5a, 5b and the I-shaped core blocks 31c to 36c of the core legs 6, a mixture obtained by adding 1.5 parts by weight of kaolin and 1.5 parts by weight of water glass to an Fe-6.5% Si alloy powder was used. This mixture was compression molded at an ordinary temperature and at a molding pressure of 1200 MPa and thereafter the green compact was subjected to heat treatment at a temperature of 1073 K in a nitrogen atmosphere. The magnetic permeability $\mu_r$ of this compacted body was 50. The adopted distance between the core joints 11c, 12c (a length obtained by adding the lengths of the protrusions 21c, 22c, the gaps G1c to G4c, and the I-shaped core blocks 31c to 33c) was 87.9 mm.

For the end portions 11c, 12c of the core joints 5a, 5b, the shape of the side opposite to the side where the protrusions 21c to 24c were fixed, was such that the external portions were rounded so as to curve along the magnetic path. The sectional area of the end portions 11c, 12c, the sectional area of the protrusions 21c to 24c, and the sectional area of the I-shaped core blocks 31c to 36c of the core legs 6, all orthogonal to the magnetic path, were made equal to each other.

For the adopted dimensions of the end portion 11c, the height "h" was 32 mm, the longitudinal width "w" was 60 mm, the transverse width "d" was 20.5 mm, and the curved surface "r" of the end portion had a radius of 20.5 mm. For the dimensions of the protrusions 21c to 24c, the length A was 16.5 mm and the height was 32 mm. The ratio A/B, which is a ratio of the length A of the protrusion and the average length B of the I-shaped core blocks in a magnetic path direction, is 1.0. This corresponds to number 1-4 in Table 4 below.

Furthermore, reactor cores in which the length A of the protrusions 21c, 22c and the length B of the I-shaped core blocks were changed, were fabricated. To ensure that the magnetic path length becomes constant, the selected distance of the core joints between the core joints 11c and 12c (a length obtained by adding the lengths of the protrusions 21c, 22c, the gaps G1c to G4c, and the I-shaped core blocks 31c to 33c) was 87.9 mm, a constant value. The adopted gap length (a length obtained by adding the lengths of the gaps G1c to G8c) was also 10.8 mm (one side, 5.4 mm), a constant value. Coils with 76 turns of the same wire material were mounted to the core legs of the reactor core and seven reactors with an inductance of approximately 275 μH at 60 A of a DC superimposed current were fabricated, and a comparison was made to know how the coil AC resistance varies depending on the ratio A/B.

Table 4 shows the values of the length A of the protrusion, the length B of the I-shaped core block, the dimensional ratio A/B, and the coil AC resistance in each of the reactors. The coil AC resistance values shown in Table 4 were obtained by measuring the series resistance of the above-described reactors at a voltage level of 0.5 V and a frequency of 10 kHz by using the measuring instrument of precision LCR meter 4284A (made by Agilent Technologies, Inc.) The AC resistance of the coil with 76 turns alone was 0.121Ω

TABLE 4

| Number | Dimension A (mm) | Dimension B (mm) | Ratio A/B | Coil AC resistance (O) |
|---|---|---|---|---|
| 1-1 | 0 | 27.5 | 0.0 | 0.393 |
| 1-2 | 6.9 | 22.9 | 0.3 | 0.328 |
| 1-3 | 11.8 | 19.6 | 0.6 | 0.279 |
| 1-4 | 14.4 | 17.9 | 0.8 | 0.255 |
| 1-5 | 16.5 | 16.5 | 1.0 | 0.248 |
| 1-6 | 21.3 | 13.3 | 1.6 | 0.249 |
| 1-7 | 23.6 | 11.8 | 2.0 | 0.262 |
| 1-8 | 25.4 | 10.6 | 2.4 | 0.277 |
| 1-9 | 30 | 7.5 | 4.0 | 0.324 |

Figure 11:
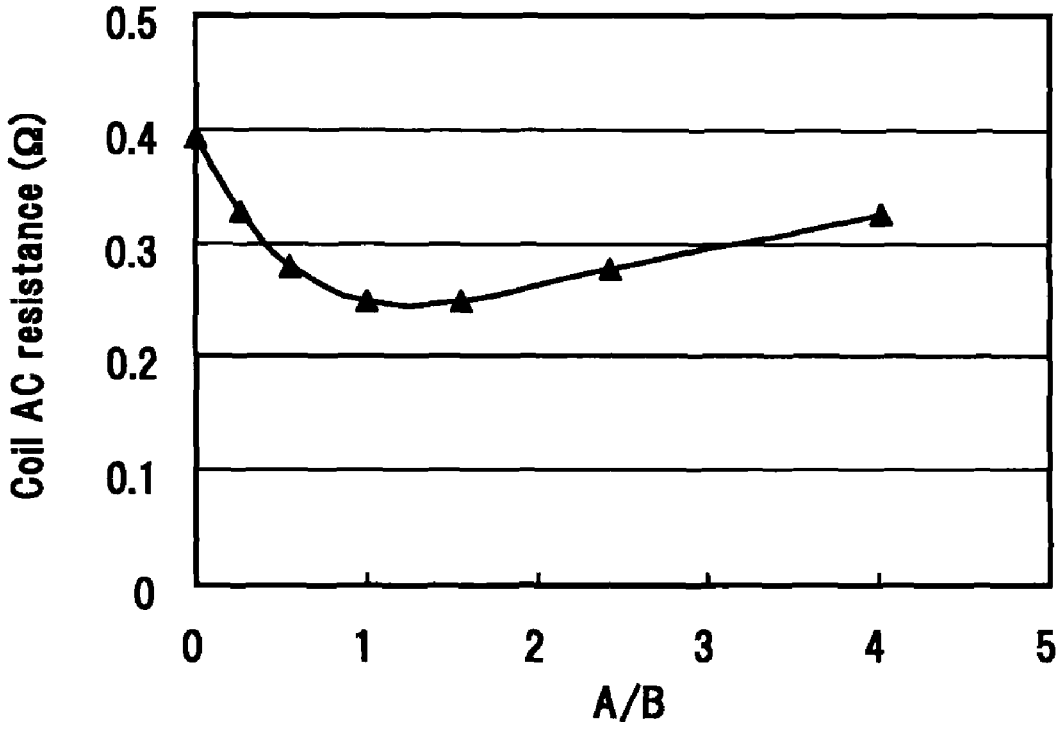
FIG. 11 is a characteristic diagram showing the relationship between the coil AC resistance of a reactor (the number of blocks=3) in Example 5 and the ratio A/B.

FIG. 11 is a diagram to explain the relationship between the ratio A/B and the coil AC resistance shown in Table 4. It became apparent from FIG. 11 that the coil AC resistance becomes a minimum at a ratio A/B in the vicinity of 1.2. The coil AC resistance becomes not more than 0.35Ω when the ratio A/B is in the range of 0.3 to 4. The coil AC resistance becomes not more than 0.3Ω when the ratio A/B is in the range of 0.6 to 2.4. Also it becomes apparent from FIG. 11 that the coil AC resistance becomes not more than 0.27Ω when the ratio A/B is in the range of 0.8 to 2.0.

Incidentally, although in the core joints of this example, the two corner surfaces on the outer side provide a curved surface with a radius of 20.5 mm, the same tendency in the ratio A/B and the coil AC resistance was observed also when the core joints were in the shape of a rectangular parallelepiped.

Example 6

In this example, an investigation was carried out as to how the relationship between the ratio A/B and the coil AC resistance varies when the dimensions (B1, B2, B3) of the I-shaped core blocks (31c to 33c; 34c to 36c) of the core legs 6 are changed respectively in the annular reactor core shown in FIG. 10.

The same core joints 5a, 5b as in Example 5 were fabricated. On the other hand, in the fabrication of the core legs 6, the dimensions (B1, B2, B3) of the I-shaped core blocks (31c, 32c and 33c; 34c, 35c, and 36c) were changed. Incidentally, other conditions were the same as shown in Example 5 (FIG. 10); the adopted distance between the core joints 11c, 12c (a length obtained by adding the lengths of the protrusions 21c, 22c, the gaps G1c to G4c, and the I-shaped core blocks 31c to 33c) was 87.9 mm, and the gap length (a length obtained by adding the lengths of G1c to G8c) was 10.8 mm (one side, 5.4 mm), a constant value. Also dimensions other than B1 to B3, the materials for the core joints 5a, 5b and the core legs 6, the manufacturing method and the like were the same as in Example 5.

Figure 12A:
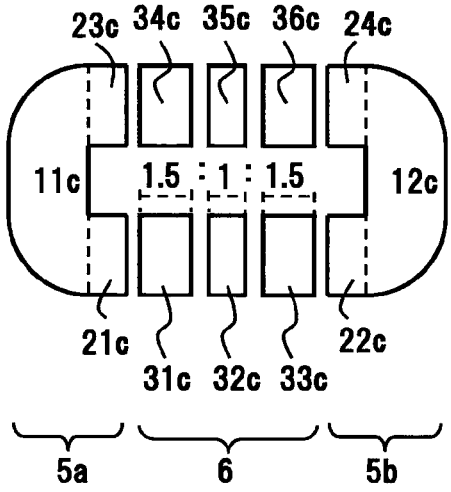
FIGS. 12A, 12B, and 12C are schematic diagrams showing the dimensional relationship of the core of a reactor in Example 6.
Figure 12B:
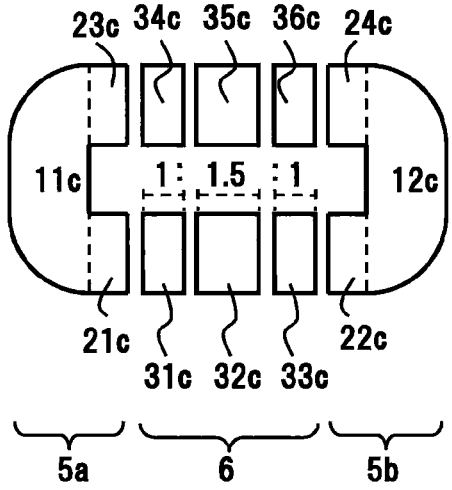
Figure 12C:
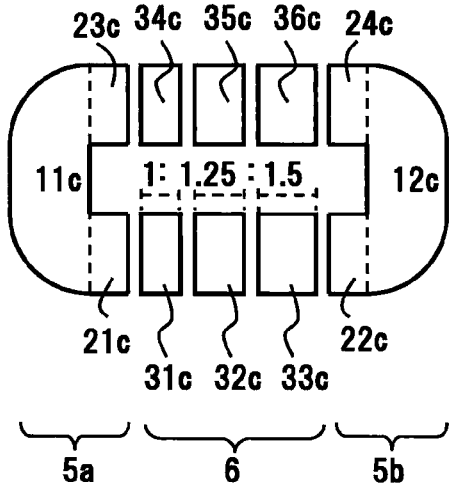

FIGS. 12A, 12B, and 12C are diagrams schematically showing the arrangement of the protrusions 21c, 22c and I-shaped core blocks 31c to 36c of the annular reactor core of this example. Gaps G are provided between the protrusions and the I-shaped core blocks and between the I-shaped core blocks.

In the annular reactor core shown in FIG. 12A, the length ratio of the I-shaped core blocks 31c, 32c, 33c is 1.5:1.0:1.5. In the annular reactor core shown in FIG. 12B, the length ratio of the I-shaped core blocks 31c, 32c, 33c is 1.0:1.5:1.0. In the annular reactor core shown in FIG. 12C, the length ratio of the I-shaped core blocks 31c, 32c, 33c is 1.0:1.2:1.44.

Table 5 shows the values of the dimensional ratio A/B and coil AC resistance of each of the I-shaped core blocks 31c, 32c, 33c. Incidentally, the length B of the I-shaped core blocks is an average length of the I-shaped core blocks 31c, 32*c*, 33*c*, which was obtained by dividing the total I-shaped core block length by the number of blocks.

TABLE 5

| Number | Dimension A (mm) | Dimensional ratio of I-shaped core blocks | Ratio A/B | Coil AC resistance (O) |
|---|---|---|---|---|
| 2-1 | 11.8 | 1.5:1.0:1.5 | 0.6 | 0.279 |
| | 16.5 | 1.5:1.0:1.5 | 1.0 | 0.251 |
| | 21.3 | 1.5:1.0:1.5 | 1.6 | 0.252 |
| | 25.4 | 1.5:1.0:1.5 | 2.4 | 0.281 |
| 2-2 | 11.8 | 1.0:1.5:1.0 | 0.6 | 0.289 |
| | 16.5 | 1.0:1.5:1.0 | 1.0 | 0.255 |
| | 21.3 | 1.0:1.5:1.0 | 1.6 | 0.257 |
| | 25.4 | 1.0:1.5:1.0 | 2.4 | 0.276 |
| 2-3 | 11.8 | 1.0:1.2:1.44 | 0.6 | 0.284 |
| | 16.5 | 1.0:1.2:1.44 | 1.0 | 0.252 |
| | 21.3 | 1.0:1.2:1.44 | 1.6 | 0.255 |
| | 25.4 | 1.0:1.2:1.44 | 2.4 | 0.279 |

In Table 5, number 2-1 indicates an annular reactor core shown in FIG. 12A in which the size of the blocks on both sides is 1.5 times that of the middle block among the three I-shaped core blocks, number 2-2 indicates an annular reactor core shown in FIG. 12B in which the size of the middle block is 1.5 times that of the blocks on both sides among the three I-shaped core blocks, and number 2-3 indicates an annular reactor core shown in FIG. 12C in which the size of the three I-shaped core blocks is increased each 1.2 times in order from one side.

With the same conditions except the dimensional ratio of the I-shaped core blocks as in Example 5 maintained, coils with 76 turns of the same wire material were mounted to the core legs of the reactor core and reactors with an inductance of approximately 275 μH at 60 A of a DC superimposed current were fabricated, and a comparison was made to know how the coil AC resistance varies depending on the ratio A/B.

Figure 13:
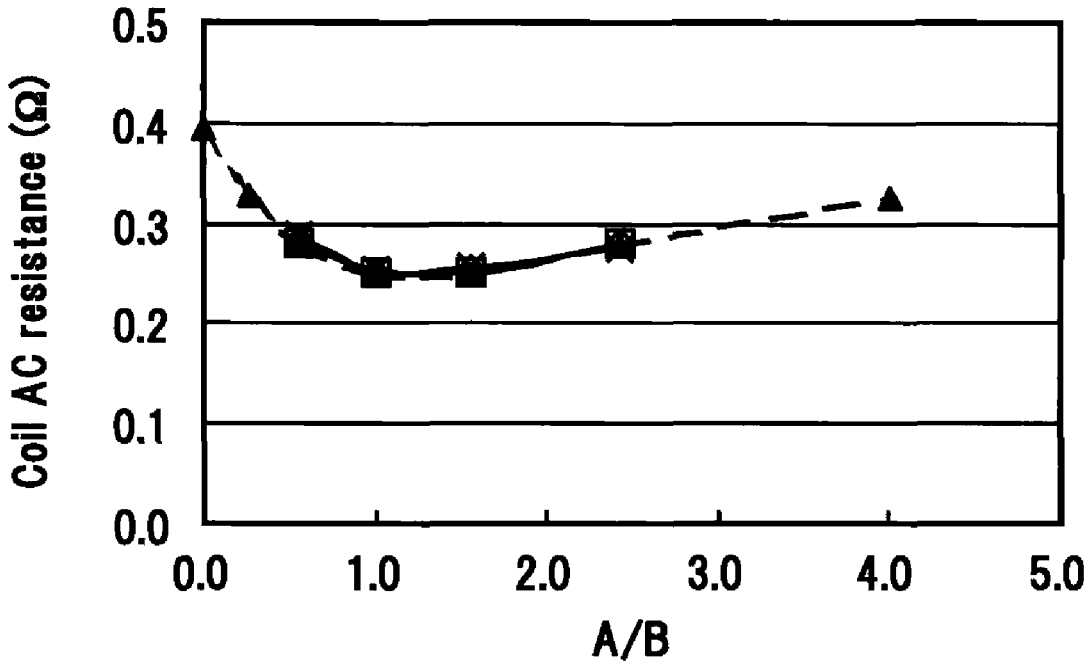
FIG. 13 is a characteristic diagram showing the relationship between the coil AC resistance and the ratio A/B, which is obtained when the dimension of each I-shaped core block within a reactor in Example 6 is changed.

FIG. 13 is a graph in which the results shown in Table 5 are superposed on the results of Example 5 (FIG. 11).

As is apparent from FIG. 13, even when the dimensions of the I-shaped core blocks are changed, this has no effect on the relationship between the ratio A/B and the coil AC resistance. This result means that even when the length of the I-shaped core blocks of the core legs is changed as required, the coil AC resistance is not so reduced as expected. Therefore, it is apparent that controlling the ratio A/B is important for reducing the coil AC resistance. Making the length of the I-shaped core blocks equal to each other as far as possible is desirable in terms of forming. Length errors of all of the I-shaped core blocks are controlled preferably to the range of 20% and more preferably to the range of 10%. Furthermore, because the shape of the whole reactor core becomes close to a point-symmetric shape, this is also effective in reducing noise.

Example 7

In this example, an investigation was made as to what effect the number of I-shaped core blocks of the core legs 6 has on the relationship between the ratio A/B and the coil AC resistance.

Figure 14A:
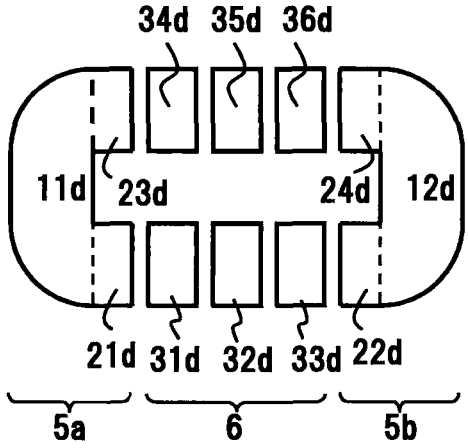
FIGS. 14A, 14B, and 14C are schematic diagrams of reactor cores having different numbers of core blocks in Example 7.
Figure 14B:
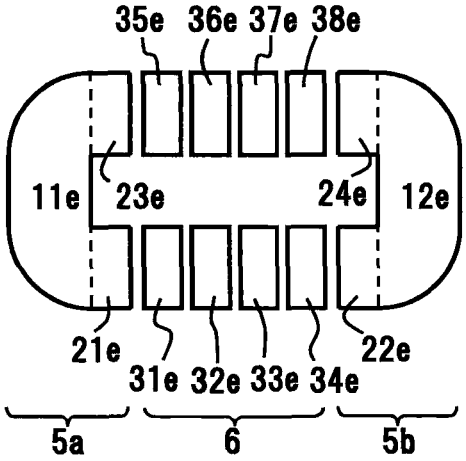
Figure 14C:
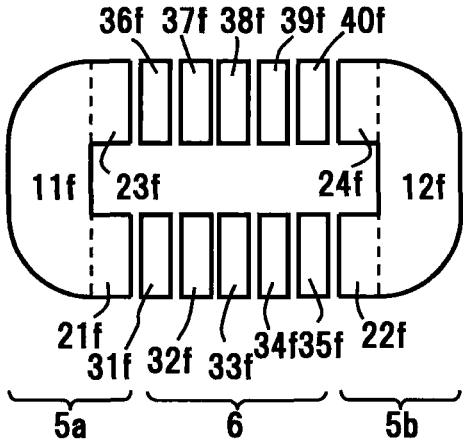

FIGS. 14A, 14*b*, and 14C are schematic diagrams of annular reactor cores used in this example. A core joint 5*a* is a U-shaped core comprising an end portion 11*d* (11*e*, 11*f*) and protrusions 21*d* (21*e*, 21*f*) and 23*d* (23*e*, 23*f*), and a core joint 5*b* provided at the other end is a U-shaped core comprising an end portion 12*d* (12*e*, 12*f*) and protrusions 22*d* (22*e*, 22*f*) and 24*d* (24*e*, 24*f*). Incidentally, the shape of the end portions of the core joints in these annular reactor cores is the same as already shown in FIG. 3.

On the other hand, for the core legs 6, three to five I-shaped core blocks per row were arranged in a tandem manner. Incidentally, the length of all of the I-shaped core blocks was made equal, and the I-shaped core blocks were arranged so that gaps were formed at both ends. The distance between the core joints was 87.9 mm, the same value as in Example 5. Also the adopted gap length was 10.8 mm (one side, 5.4 mm), a constant value. Other dimensions, the materials for the core joints and core legs, the manufacturing method and the like were the same as in Example 5.

In the same manner as in Example 5, coils with 76 turns of the same wire material were mounted to the core legs of the reactor core and reactors with an inductance of approximately 275 μH at 60 A of a DC superimposed current were fabricated, and a comparison was made to know how the coil AC resistance varies depending on the ratio A/B. The results are shown in Table 6.

TABLE 6

| | Coil AC resistance (O) | | |
|---|---|---|---|
| Ratio A/B | Number of blocks n = 3 (FIG. 14A) | Number of blocks n = 4 (FIG. 14B) | Number of blocks n = 5 (FIG. 14(C)) |
| 0 | 0.393 | 0.326 | 0.277 |
| 0.3 | 0.328 | 0.288 | 0.253 |
| 0.4 | — | 0.283 | 0.243 |
| 0.5 | — | 0.267 | — |
| 0.6 | 0.279 | — | 0.234 |
| 0.8 | 0.255 | 0.252 | 0.226 |
| 1.0 | 0.248 | — | 0.222 |
| 1.4 | — | 0.249 | — |
| 1.6 | 0.249 | — | — |
| 1.8 | — | — | 0.217 |
| 2.0 | 0.262 | — | — |
| 2.2 | — | 0.250 | — |
| 2.4 | 0.277 | — | — |
| 2.8 | — | — | 0.229 |
| 3.3 | — | — | 0.24 |
| 3.5 | — | 0.274 | — |
| 4.0 | 0.324 | 0.285 | 0.252 |
| 4.4 | — | — | 0.260 |
| 6.0 | — | 0.320 | — |
| 7.5 | — | — | 0.300 |

Figure 15:
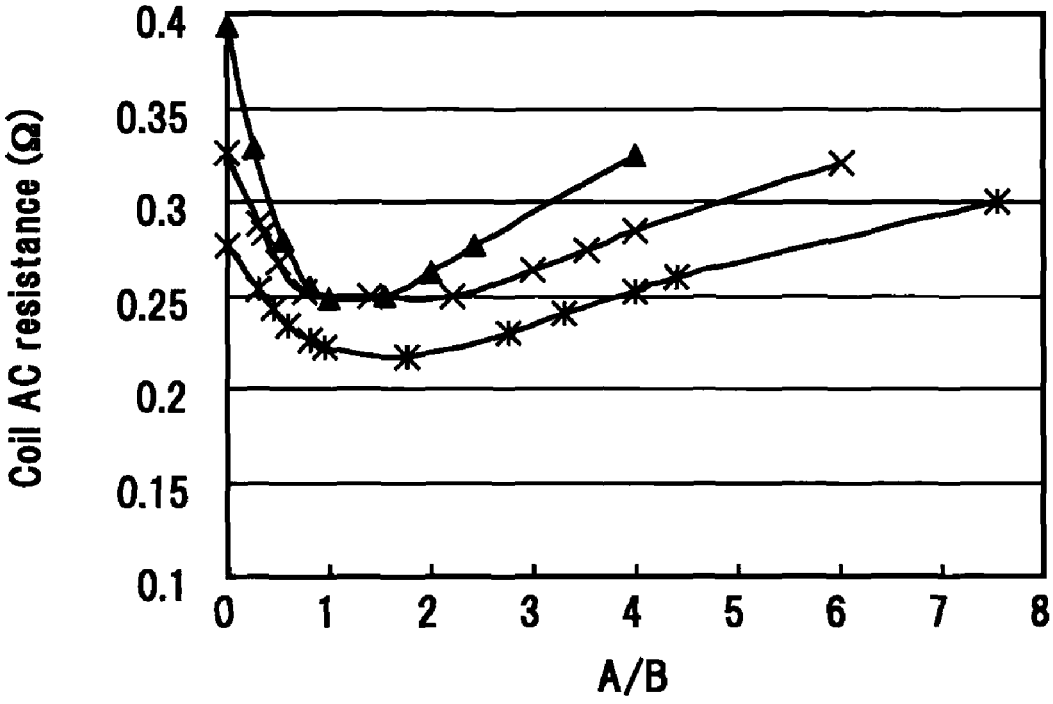
FIG. 15 is a characteristic diagram showing the relationship between the coil AC resistance and the ratio A/B, which is obtained when the number of I-shaped core blocks in Example 7 is changed (the number of blocks=3, 4, 5).

FIG. 15 is a graph of the results shown in Table 6. As shown in FIG. 15, it is apparent that the coil AC resistance decreases with increasing number of I-shaped core blocks. Also there is observed the tendency that the ratio A/B at which the coil AC resistance decreases increases with increasing number of I-shaped core blocks.

When the number of I-shaped core blocks is 3, if the range of the ratio A/B, which is a ratio of the length A of the protrusion of the core joint to the length B of the I-shaped core blocks in a magnetic path direction, is not less than 0.3 but not more than 4.0, it is possible to reduce the coil AC resistance as much as not less than 15% compared to a case where the core joints are not provided with a protrusion (a case where the ratio A/B=0).

Furthermore, if the range of the ratio A/B is not less than 0.6 but not more than 2.4, it is possible to reduce the coil AC resistance as much as not less than 25% compared to a case where the core joints are not provided with a protrusion (a case where the ratio A/B=0). If the ratio A/B is not less than 0.8 but not more than 2.0, it is possible to reduce the coil AC resistance as much as not less than 30%.

Also, when the number of I-shaped core blocks is 4, if the range of the ratio A/B, which is a ratio of the length A of the protrusion of the core joint to the length B of the I-shaped core blocks in a magnetic path direction, is not less than 0.3 but not more than 4.0, it is possible to reduce the coil AC resistance as much as not less than 10% compared to a case where the core joints are not provided with a protrusion (a case where the ratio A/B=0).

Furthermore, if the range of the ratio A/B is not less than 0.5 but not more than 3.5, it is possible to reduce the coil AC resistance as much as not less than 15%. Furthermore, if the range of the ratio A/B is not less than 0.8 but not more than 2.2, it is possible to reduce the coil AC resistance as much as not less than 20%.

Also, when the number of I-shaped core blocks is 5, if the range of the ratio A/B, which is a ratio of the length A of the protrusion of the core joint to the length B of the I-shaped core blocks in a magnetic path direction, is not less than 0.3 but not more than 4.0, it is possible to reduce the coil AC resistance as much as not less than 7% compared to a case where the core joints are not provided with a protrusion (a case where the ratio A/B=0).

Furthermore, if the range of the ratio A/B is not less than 0.6 but not more than 3.3, it is possible to reduce the coil AC resistance as much as not less than 13%. Furthermore, if the range of the ratio A/B is not less than 0.8 but not more than 2.8, it is possible to reduce the coil AC resistance as much as not less than 15%.

When the number of I-shaped core blocks is not less than 6, the ratio A/B can be set in a range almost the same as when the number of I-shaped core blocks is 5. However, because an increase in forming costs is caused by an increase in the number of I-shaped core blocks, it is preferred that substantially, the number of I-shaped core blocks be within 5.

Example 8

An investigation similar to those of Examples 1 to 7 was verified by using magnetic field analysis software, it could be ascertained that a correlation held for an increase and decrease relationship between the coil AC resistance and the ratio A/B although differences in the values of the coil AC resistance arose.

When it was assumed that annular reactor cores were fabricated using other soft magnetic powders (a powder of pure iron, an Fe—Al alloy powder, an Fe—Si—Al alloy powder, an Fe—Ni alloy powder, an Fe—Co alloy powder, an amorphous soft magnetic powder, and a nanocrystalline soft magnetic powder) and the relationship between the coil AC resistance and the ratio A/B of these annular reactor cores was analyzed by using magnetic field analysis software, an effect similar to the above-described effect was obtained for the relationship between the increase and decrease relationship between the ratio A/B and the coil AC resistance although there were small differences in the values of the coil AC resistance. When a compacted body is used in the annular reactor core, it is preferred that the ratio A/B be within the ranges of the present invention whichever of the above-described alloy powders may be used.

The invention claimed is:

1. An annular reactor core comprising two opposed core joints and two core legs each composed of one core block and arranged between the core joints, wherein each of the core joints is U-shaped or circular-arc shaped and comprises two opposed protrusions extending toward the core legs, such that the core legs are positioned between the opposed core joints and define a gap between the core legs and each of the protrusions, and wherein the ratio A/B, which is a ratio of the length A of the protrusions to the average length B of each core block in a magnetic path direction, is not less than 0.3 but not more than 8.0.

2. The reactor core according to claim 1, wherein the core joints and the core legs are formed from a compacted body containing a magnetic powder and a resin.

3. The reactor core according to claim 2, wherein the magnetic permeability of the compacted powder body is not more than 200.

4. A reactor comprising the reactor core according to claim 1, wherein a coil is wound around the core legs.

5. The reactor according to claim 4, wherein the reactor comprises a component in a power conditioner.

6. An annular reactor core comprising two opposed core joints and two core legs each composed to two core blocks and arranged between the core joints, wherein each of the core joints is U-shaped or circular-arc shaped and comprises two opposed protrusions extending toward the core legs, such that the core legs are positioned between the opposed core joints and define a gap between the core legs and each of the protrusions, and wherein the ratio A/B, which is a ratio of the length A of the protrusions to the average length B of each core block in a magnetic path direction, is not less than 0.8 but not more than 1.5.

7. The reactor core according to claim 6, wherein the core joints and the core legs are composed of a compacted body containing a magnetic powder and a resin.

8. The reactor core according to claim 7, wherein the magnetic permeability of the compacted body is not more than 200.

9. A reactor comprising the reactor core according to claim 6, wherein a coil is wound around the core legs.

10. The reactor according to claim 9, wherein the reactor comprises a component in a hybrid electric vehicle.

11. An annular reactor core comprising two opposed core joints and two core legs each composed of (n) core blocks and arranged between the core joints, wherein (n) is an integer of 3 or greater, wherein each of the core joints is U-shaped or circular-arc shaped and comprises two opposed protrusions extending toward the core legs, such that the core legs are positioned between the opposed core joints and define a gap between the core legs and each of the protrusions, and wherein the ratio A/B, which is a ratio of the length A of the protrusions to the average length B of each core block in a magnetic path direction, is not less than 0.3 but not more than 4.0.

12. The reactor core according to claim 11, wherein the integer n is 3 and the ratio A/B is not less than 0.6 but not more than 2.4.

13. The reactor core according to claim 11, wherein the integer n is 4 and the ratio A/B is not less than 0.5 but not more than 3.5.

14. The reactor core according to claim 11, wherein the integer n is 5 and the ratio A/B is not less than 0.6 but not more than 3.3.

15. The reactor core according to claim 11, wherein the core joints and the core legs are each composed of a compacted body containing a magnetic powder and a resin.

16. The reactor core according to claim 15, wherein the magnetic permeability of the compacted body is not more than 200.

17. A reactor comprising the reactor core according to claim 11, wherein a coil is wound around the core legs.

18. The reactor according to claim 17, wherein the reactor is a component in a hybrid electric vehicle.

* * * * *